US011179622B2

(12) United States Patent
Turkbas

(10) Patent No.: US 11,179,622 B2
(45) Date of Patent: Nov. 23, 2021

(54) MOUTHGUARD WITH TAPERED BREATHING CHANNEL

(71) Applicant: Shock Doctor, Inc., Fountain Valley, CA (US)

(72) Inventor: Jay N. Turkbas, Huntington Beach, CA (US)

(73) Assignee: Shock Doctor, Inc., Fountain Valley, CA (US)

( * ) Notice: Subject to any disclaimer, the term of this patent is extended or adjusted under 35 U.S.C. 154(b) by 338 days.

(21) Appl. No.: 16/244,521

(22) Filed: Jan. 10, 2019

(65) Prior Publication Data

US 2019/0209911 A1 Jul. 11, 2019

Related U.S. Application Data

(60) Provisional application No. 62/615,747, filed on Jan. 10, 2018.

(51) Int. Cl.
*A63B 71/08* (2006.01)
*A63B 1/00* (2006.01)

(52) U.S. Cl.
CPC ..... *A63B 71/085* (2013.01); *A63B 1/00* (2013.01); *A63B 2071/086* (2013.01)

(58) Field of Classification Search
CPC ..... A61F 2/20; A61F 2005/563; A61F 5/50; A61F 5/58; A61F 2/00; A61F 5/566; A61F 5/56; A63B 2071/088; A63B 71/085; A63B 2209/02; A63B 2071/086; A61B 13/00; A61B 1/24; A61C 5/14
See application file for complete search history.

(56) References Cited

U.S. PATENT DOCUMENTS

| | | | |
|---|---|---|---|
| 1,146,264 | A | 7/1915 | Kelly |
| 1,505,642 | A | 8/1924 | Henry |
| 1,569,947 | A | 1/1926 | Buttress |
| 1,720,439 | A | 7/1929 | Richardson |
| 2,312,171 | A | 2/1943 | Jochum |
| 2,444,294 | A | 6/1948 | Jones |

(Continued)

FOREIGN PATENT DOCUMENTS

| | | | |
|---|---|---|---|
| AU | 2013205854 | A1 | 3/2014 |
| GB | 2491183 | A | 11/2012 |
| WO | 2014/093850 | A1 | 6/2014 |

OTHER PUBLICATIONS

European Search Report issued in EP Application No. 14757382.6 dated Nov. 2, 2016, 9 pages.

(Continued)

*Primary Examiner* — Ophelia A Hawthorne
(74) *Attorney, Agent, or Firm* — Faegre Drinker Biddle & Reath LLP

(57) ABSTRACT

A mouthguard according to an embodiment of the present disclosure includes a pair of spaced lateral bite wings, a conduit defining an air channel extending between forward portions of the lateral bite wings, and a lip shield member and/or a flange disposed around and extending radially outward with respect to a forward end of the conduit. The conduit is tapered inward from its forward end toward its rearward end, and defines an incisor engaging surface proximate the rearward end of the conduit, and a lip engaging surface between the incisor engaging surface and the forward end of the conduit.

24 Claims, 10 Drawing Sheets

(56) References Cited

U.S. PATENT DOCUMENTS 2,521,039 A 9/1950 Carpenter
2,827,899 A 3/1958 Altieri
2,966,908 A 1/1961 Cathcart et al.
3,089,487 A 5/1963 Enicks et al.
3,103,217 A 9/1963 Butler et al.
3,207,153 A 9/1965 Goldstein
3,223,085 A 12/1965 Gores et al.
3,228,107 A 1/1966 Zandberg
3,234,942 A 2/1966 Simor
3,236,235 A 2/1966 Jacobs
3,247,844 A 4/1966 Berghash
3,312,218 A 4/1967 Jacobs
3,333,582 A 8/1967 Cathcart
3,411,501 A 11/1968 Greenberg
D212,848 S 12/1968 Westlund
3,457,916 A 7/1969 Wolicki
3,496,936 A 2/1970 Gores
3,505,995 A 4/1970 Greenberg
3,692,025 A 9/1972 Greenberg
3,768,465 A 10/1973 Helmer
3,788,314 A 1/1974 Noreen
3,878,610 A 4/1975 Coscina
RE28,667 E 12/1975 Gores
4,134,400 A 1/1979 DiMatteo
D263,073 S 2/1982 Jonkers et al.
D268,962 S 5/1983 Adams et al.
D273,527 S 4/1984 Pota
4,471,772 A 9/1984 Miller, Jr.
4,495,945 A 1/1985 Liegner
4,568,280 A 2/1986 Ahlin
4,610,743 A 9/1986 Salmeen et al.
4,944,947 A 7/1990 Newman
4,977,905 A 12/1990 Kittelsen et al.
5,031,638 A 7/1991 Castaldi
5,063,940 A 11/1991 Adell et al.
5,078,367 A 1/1992 Simpson et al.
5,117,816 A 6/1992 Shapiro et al.
D328,494 S 8/1992 Schwendeman et al.
D328,965 S 9/1992 Ewing
5,165,424 A 11/1992 Silverman
5,259,762 A 11/1993 Farrell
5,277,203 A 1/1994 Hays
5,293,880 A 3/1994 Levitt
5,336,086 A 8/1994 Simmen et al.
5,339,832 A 8/1994 Kittelsen et al.
5,406,963 A 4/1995 Adell
5,566,683 A 10/1996 Keith
5,611,355 A 3/1997 Hilsen
5,642,737 A 7/1997 Parks
D382,965 S 8/1997 Wagner
5,692,523 A 12/1997 Croll et al.
5,693,523 A 12/1997 Watanabe et al.
5,794,274 A 8/1998 Kraemer
5,826,581 A 10/1998 Yoshida
5,842,860 A 12/1998 Funt
D406,647 S 3/1999 Wagner
D414,281 S 9/1999 Sassenberg
5,970,981 A 10/1999 Ochel
6,036,487 A 3/2000 Westerman
6,068,475 A 5/2000 Stoyka, Jr.
6,081,932 A 7/2000 Kraemer
6,082,363 A 7/2000 Washburn
6,280,196 B1 8/2001 Berghash
D452,011 S 12/2001 Redhage
6,405,729 B1 6/2002 Thornton
6,450,167 B1 9/2002 David et al.
6,491,036 B2 12/2002 Cook
6,494,210 B1 12/2002 Mams
6,584,978 B1 7/2003 Brett et al.
6,691,710 B2 2/2004 Kittelsen et al.
D492,785 S 7/2004 Garabito
D493,578 S 7/2004 Manzo et al.
D500,895 S 1/2005 Manzo et al.
D509,028 S 8/2005 Farrell
6,978,786 B2 12/2005 Sabbagh
D523,994 S 6/2006 Manzo
D525,749 S 7/2006 Manzo et al.
D526,093 S 8/2006 Manzo et al.
D526,095 S 8/2006 Manzo et al.
D527,848 S 9/2006 Manzo et al.
D530,863 S 10/2006 Manzo et al.
D532,559 S 11/2006 Manzo et al.
D537,986 S 3/2007 Manzo et al.
D537,987 S 3/2007 Manzo et al.
D538,926 S 3/2007 Jeong et al.
D539,429 S 3/2007 Wong
D541,481 S 4/2007 Farrell
7,210,483 B1 5/2007 Lesniak et al.
7,216,371 B2 5/2007 Wong
D548,402 S 8/2007 Trodick
D548,403 S 8/2007 Manzo et al.
7,299,804 B2 11/2007 Kittelsen et al.
D593,714 S 6/2009 Hirshberg
7,549,423 B1 6/2009 Hirshberg
D603,101 S 10/2009 Hirshberg
7,658,193 B2 2/2010 Lesniak
D611,658 S 3/2010 Manzo
D614,304 S 4/2010 Jansheski
D615,709 S 5/2010 Manzo
D616,152 S 5/2010 Manzo
D618,399 S 6/2010 Manzo
7,757,310 B2 7/2010 Wong
7,775,214 B1 8/2010 Lesniak et al.
D623,357 S 9/2010 Manzo et al.
D626,292 S 10/2010 Farrell
D627,107 S 11/2010 Manzo et al.
D630,382 S 1/2011 Manzo et al.
D630,860 S 1/2011 Sichel
D634,480 S 3/2011 Manzo et al.
D636,074 S 4/2011 Levine
7,954,496 B2 6/2011 Jansheski et al.
D641,478 S 7/2011 Belvedere et al.
D642,277 S 7/2011 Farrell
D644,791 S 9/2011 Petrocelli
8,033,392 B1 10/2011 Gehner et al.
D648,900 S 11/2011 Manzo
D649,252 S 11/2011 Spainhower
D652,575 S 1/2012 Farrell
D652,576 S 1/2012 Farrell
D654,595 S 2/2012 Farrell
8,116,854 B2 2/2012 Hart et al.
D658,813 S 5/2012 Manzo
D663,485 S 7/2012 Turkbas et al.
D663,486 S 7/2012 Turkbas et al.
8,235,052 B2 8/2012 Maurello
8,496,009 B2 7/2013 Manzo
D688,832 S 8/2013 Polk, III
D693,966 S 11/2013 Hanson
8,607,798 B2 12/2013 Turkbas et al.
8,739,599 B2 6/2014 Hennig et al.
D710,506 S 8/2014 Tolentino et al.
8,800,184 B1 8/2014 Lerman et al.
D714,066 S 9/2014 Thuma et al.
8,931,488 B2 * 1/2015 Evans ..... A63B 71/085
128/861
D727,571 S 4/2015 Brett et al.
D728,162 S 4/2015 Gottsch
D734,556 S 7/2015 Brett et al.
D743,107 S 11/2015 Hirshberg
D743,108 S 11/2015 Charlton
D752,295 S 3/2016 Lovat
9,375,289 B1 6/2016 Walls
D760,889 S 7/2016 Evans et al.
D765,919 S 9/2016 Croll
D782,743 S 3/2017 Engel et al.
9,622,837 B2 4/2017 Jansheski
D795,439 S 8/2017 Mounce
D795,501 S 8/2017 Levine
9,731,103 B1 8/2017 Rouse et al.
D797,379 S 9/2017 Patel et al.
D799,049 S 10/2017 Farrell
D800,317 S 10/2017 Farrell
D804,043 S 11/2017 Gildersleeve
D804,829 S 12/2017 Austin

(56) References Cited

U.S. PATENT DOCUMENTS

| | | | |
|---|---|---|---|
| D807,583 | S | 1/2018 | Evans |
| D814,053 | S | 3/2018 | Darrow et al. |
| D815,291 | S | 4/2018 | Farrell |
| D816,210 | S | 4/2018 | Gerschman et al. |
| D830,640 | S | 10/2018 | Supple |
| D833,621 | S | 11/2018 | Tolentino |
| D833,681 | S | 11/2018 | Tolentino et al. |
| D839,485 | S | 1/2019 | Turkbas |
| D841,257 | S | 2/2019 | Turkbas |
| 10,213,677 | B1 | 2/2019 | Hirshberg |
| D852,424 | S | 6/2019 | Callabe |
| 10,314,679 | B2 | 6/2019 | Blank et al. |
| D853,043 | S | 7/2019 | Turkbas |
| D853,655 | S | 7/2019 | Turkbas |
| D854,679 | S | 7/2019 | Gerschman et al. |
| D854,753 | S | 7/2019 | Turkbas |
| D857,301 | S | 8/2019 | Turkbas |
| D867,673 | S | 11/2019 | Turkbas |
| D869,774 | S | 12/2019 | Turkbas |
| 10,661,062 | B2 | 5/2020 | Turkbas |
| 2003/0019497 | A1 | 1/2003 | Farrell |
| 2003/0075184 | A1 | 4/2003 | Persichetti |
| 2003/0136416 | A1 | 7/2003 | White |
| 2003/0205234 | A1 | 11/2003 | Bardach et al. |
| 2004/0076219 | A1 | 4/2004 | Madison et al. |
| 2004/0110111 | A1 | 6/2004 | Wasylucha |
| 2004/0146836 | A1 | 7/2004 | Andersen |
| 2004/0146837 | A1 | 7/2004 | Andersen |
| 2004/0154626 | A1 | 8/2004 | Washburn et al. |
| 2005/0019524 | A1 | 1/2005 | Kershaw |
| 2006/0021622 | A1 | 2/2006 | Buffington |
| 2006/0084024 | A1 | 4/2006 | Farrell |
| 2007/0084471 | A1 | 4/2007 | Napoli et al. |
| 2007/0151567 | A1 | 7/2007 | Maurello |
| 2007/0151568 | A1 | 7/2007 | Maurello |
| 2007/0235039 | A1 | 10/2007 | Gottsch |
| 2007/0254256 | A1 | 11/2007 | Farrell |
| 2008/0113143 | A1 | 5/2008 | Taylor |
| 2008/0138766 | A1 | 6/2008 | Jansheski |
| 2009/0038624 | A1 | 2/2009 | Akervall et al. |
| 2010/0051038 | A1 | 3/2010 | Quigless |
| 2010/0055233 | A1 | 3/2010 | Macinnis et al. |
| 2010/0196837 | A1 | 8/2010 | Farrell |
| 2010/0304338 | A1 | 12/2010 | Cramer et al. |
| 2011/0005531 | A1 | 1/2011 | Manzo |
| 2011/0114100 | A1 | 5/2011 | Alvarez et al. |
| 2011/0186055 | A1 | 8/2011 | Makkar et al. |
| 2011/0214478 | A1 | 9/2011 | Hennig et al. |
| 2011/0230587 | A1 | 9/2011 | Macinnis et al. |
| 2012/0017922 | A1 | 1/2012 | Hirshberg |
| 2012/0085354 | A1 | 4/2012 | Polk, III |
| 2012/0090625 | A1 | 4/2012 | Evans et al. |
| 2012/0111343 | A1 | 5/2012 | Turkbas et al. |
| 2012/0174932 | A1 | 7/2012 | Wilson |
| 2013/0052613 | A1 | 2/2013 | Chetiar et al. |
| 2013/0068237 | A1 | 3/2013 | Herman et al. |
| 2013/0074850 | A1 | 3/2013 | Lenart |
| 2013/0087157 | A1 | 4/2013 | Hawkins |
| 2013/0104913 | A1 | 5/2013 | Evans et al. |
| 2014/0090655 | A1 | 4/2014 | Robinson |
| 2014/0093836 | A1 | 4/2014 | Wolpo |
| 2014/0166024 | A1 | 6/2014 | Davidson et al. |
| 2014/0238416 | A1 | 8/2014 | Lin |
| 2014/0238417 | A1 | 8/2014 | Turkbas |
| 2014/0238418 | A1 | 8/2014 | Turkbas |
| 2014/0261465 | A1 | 9/2014 | Turkbas |
| 2014/0345626 | A1 | 11/2014 | Brett et al. |
| 2014/0352704 | A1 | 12/2014 | Farrell |
| 2015/0209645 | A1* | 7/2015 | Zents ..... A42B 3/20 128/861 |
| 2016/0001160 | A1 | 1/2016 | Engel |
| 2017/0120135 | A1 | 5/2017 | Engel et al. |
| 2017/0172717 | A1 | 6/2017 | Deng et al. |
| 2017/0312613 | A1 | 11/2017 | Wright |
| 2018/0014912 | A1 | 1/2018 | Radmand |
| 2019/0015726 | A1 | 1/2019 | Turkbas |

OTHER PUBLICATIONS

Extended European Search Report issued in EP application No. 14756802.6, dated Oct. 31, 2016, 10 pages.

Gel Max Mouthguard, earliest comment Aug. 26, 2015, [online], [site visited Apr. 13, 2018]. Retrieved from url:https://www.shockdoctor.com/gel-max-mouthguard (Year: 2015).

Gel Max Power Mouthguard, earliest comment Oct. 9, 2017, [online], [site visited Apr. 13, 2018]. Retrieved from url:https://www.shockdoctor.com/gel-max-power-mouthguard (Year 2017).

International Preliminary Report on Patentability issued in PCT/US2014/018755, dated Sep. 1, 2015, 5 pages.

International Preliminary Report on Patentability issued in PCT/US2014/018756, dated Sep. 11, 2015, 8 pages.

International Search Report and Written Opinion issued in PCT/US2014/018755, dated May 22, 2014, 8 pages.

International Search Report and Written Opinion issued in PCT/US2014/018756, dated Jun. 3, 2014, 11 pages.

International Search Report and Written Opinion issued in PCT/US2016/054693, dated Jul. 24, 2017, 17 pages.

PCT Invitation to Pay Additional Fees issued in PCT/US2016/054693, dated May 23, 2017, 14 pages.

Shock Doctor Gel Max Mouthguard, www.shockdoctor.com/gel-max-mouthguard, accessed Jan. 24, 2017, at least available on Apr. 10, 2016.

Shock Doctor Max AirFlow Football Mouthguard (2016 Version), www.shockdoctor.com/max-airflow-mouthguard-2016, accessed May 9, 2018, at least available in Apr. 2016.

Shock Doctor SuperFit Mouthguard, www.shockdoctor.com/supertit-mouthguard, accessed Jan. 24, 2017, at least available on Apr. 10, 2016.

Shock Doctor Ultra Double Braces Mouthguard, www.shockdoctor.com/ultra-double-braces-mouthguard, accessed Jan. 24, 2017, at least available on Apr. 10, 2016.

Shock Doctor Ultra2 STC Mouthguard, www.shockdoctor.com/ultra2-stc-mouthguard, accessed Jan. 24, 2017, at least available on Apr. 10, 2016.

SuperFit Basketball Mouthguard, earliest comment Jul. 17, 2017, [online], [site visited Apr. 13, 2018]. Retrieved from url: https://www .shockdoctor.com/superfit-basketball-mouthguard-9200 (Year: 2017).

U.S. Appl. No. 29/610,727 entitled Mouthguard, filed Jul. 14, 2017.

U.S. Appl. No. 29/610,733 entitled Mouthguard, filed Jul. 14, 2017.

U.S. Appl. No. 29/629,806 entitled Moutguard, filed Dec. 15, 2017.

* cited by examiner

MOUTHGUARD WITH TAPERED BREATHING CHANNEL

CROSS-REFERENCE TO RELATED APPLICATION

The present application claims the benefit of and priority, under 35 U.S.C. § 119(e), to U.S. Application Ser. No. 62/615,747, filed on Jan. 10, 2018 which is hereby incorporated herein by reference in its entirety for all that it teaches and for all purposes.

TECHNICAL FIELD

The present invention relates to mouthguards for protecting a wearer's mouth during physical activities. More specifically, the present invention relates to mouthguards that include breathing channels.

BACKGROUND

Mouthguards are typically used to protect a wearer's teeth, oral tissue, and gums from impact and abrasion. Mouthguards may reduce the chance of shock and other injuries resulting from impacts during athletic activities. Some mouthguards include breathing channels to facilitate breathing therethrough.

SUMMARY

In one Example, a mouthguard comprising a pair of spaced lateral bite wings, a conduit and a front lip shield member. The lateral bit wings, each have an upper teeth engaging surface, a lower teeth engaging surface, a forward portion and a rearward portion. The conduit is disposed between the forward portions of the lateral bite wings, the conduit having a forward end, a rearward end, and upper and lower walls extending between the forward and rearward ends of the conduit, the conduit defining an air channel extending therethrough from the forward end to the rearward end. The air channel has a front opening at the forward end of the conduit and a rear opening at the rearward end of the conduit. The front lip shield member is disposed about and extends radially outward with respect to the forward end of the conduit, wherein the front lip shield member includes a rear face positioned and shaped to confront an outer surface of a user's lips when in use. The conduit is tapered inward from the forward end to the rearward end thereof such that a distance between the upper and lower walls at the forward end is greater than a distance between the upper and lower walls at the rearward end. The front opening of the air channel has a larger cross-sectional area than the rear opening of the air channel. The upper and lower walls define, respectively an upper incisor engaging surface and a lower incisor engaging surface, the upper and lower incisor engaging surfaces being located proximate the rearward end of the conduit.

In another Example, a mouthguard comprising a pair of spaced lateral bit wings and a conduit. The lateral bite wings each have an upper teeth engaging surface, a lower teeth engaging surface, a forward portion and a rearward portion. The conduit is disposed between the forward portions of the lateral bite wings, and has a forward end, a rearward end, and upper and lower walls extending between the forward and rearward ends of the conduit, the conduit defining an air channel extending therethrough from the forward end to the rearward end, the air channel having a front opening at the forward end of the conduit and a rear opening at the rearward end of the conduit. The conduit is tapered inward from the forward end to the rearward end thereof such that a distance between the upper and lower walls at the forward end is greater than a distance between the upper and lower walls at the rearward end. The front opening of the air channel has a larger cross-sectional area than the rear opening of the air channel. The upper wall defines an upper incisor engaging surface proximate the rearward end of the conduit, and an upper lip engaging surface located between the upper incisor engaging surface and the forward end of the conduit. The lower wall defines a lower incisor engaging surface proximate the rearward end of the conduit, and a lower lip engaging surface located between the lower incisor engaging surface and the forward end of the conduit.

In another Example, a method of forming a mouthguard, the method comprising forming a core layer of a first material having a first durometer, the core layer having a generally tubular structure defined by an outer wall having opposite upper and lower sides and opposite lateral sides therebetween, the upper and lower sides and the lateral sides defining a front opening and a rear opening of the core layer, wherein the upper and lower sides and the lateral sides taper inward from the front opening toward the rear opening such that the front opening has a larger cross-sectional area than the rear opening. Next, the method includes molding an outer layer of a second material over and about the core layer to form a conduit having a forward end and a rearward end and an air channel extending therethrough, the second material having a second durometer lower than the first durometer, wherein the outer layer defines upper and lower incisor engaging surfaces proximate the rearward end of the conduit, and upper and lower lip engaging surfaces between the incisor engaging surfaces and the forward end of the conduit. The method further includes molding a pair of spaced lateral bite wings on opposite sides of the conduit, each of the lateral bite wings having an upper teeth engaging surface, a lower teeth engaging surface, a forward portion and a rearward portion, wherein the conduit is disposed between the forward portions of the lateral bite wings.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

FIG. 11, according to some embodiments;

FIG. 11, according to some embodiments;

FIG. 11, according to some embodiments;

FIG. 11 taken along line 16-16 of FIG. 14, according to some embodiments;

Figure 1:
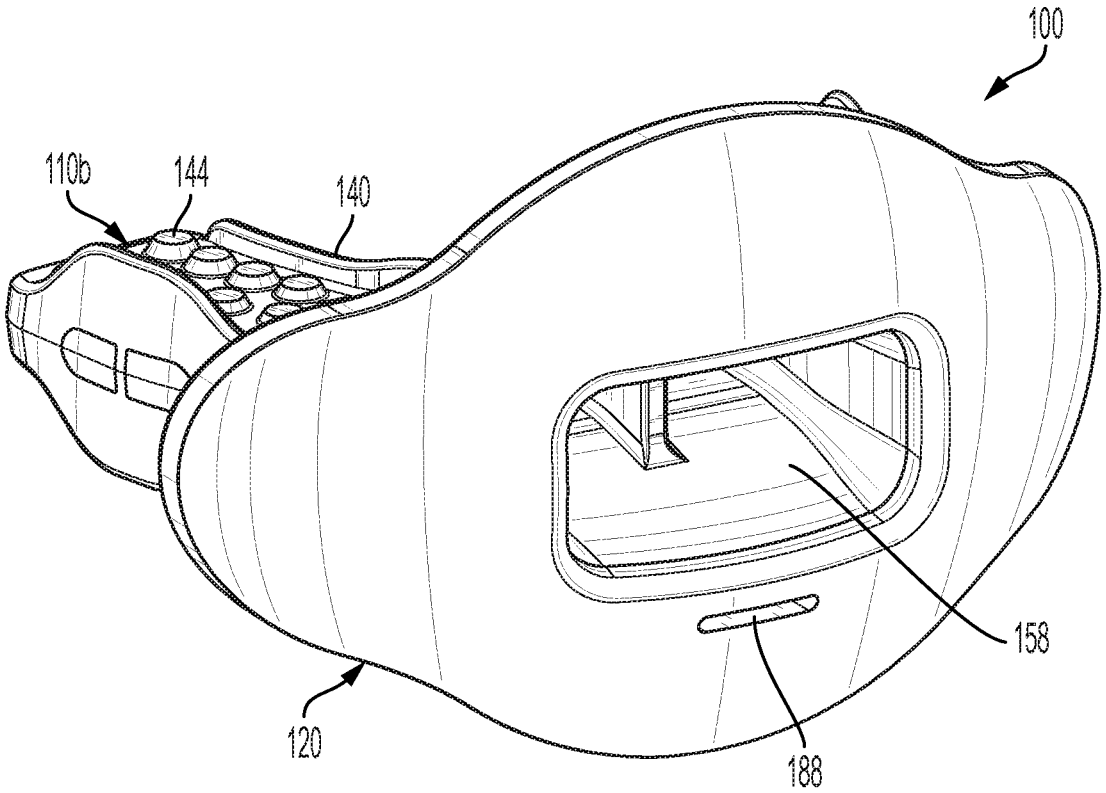
FIG. 1 is a front perspective view of a mouthguard, according to some embodiments.
Figure 2:
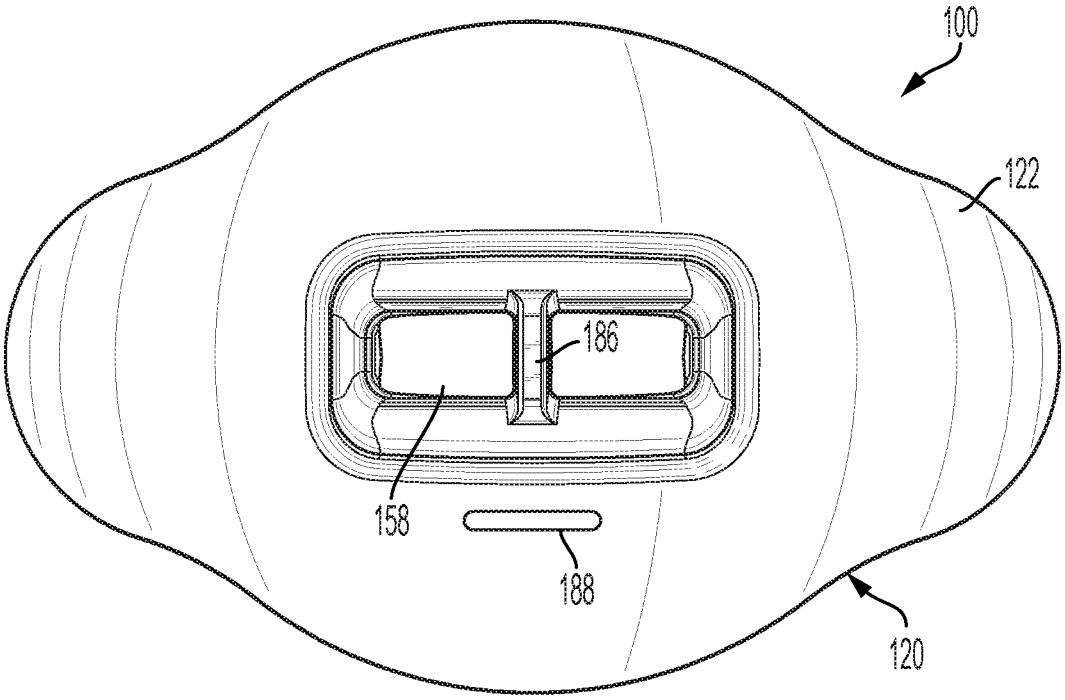
FIG. 2 is a front view of the mouthguard of FIG. 1, according to some embodiments.
Figure 3:
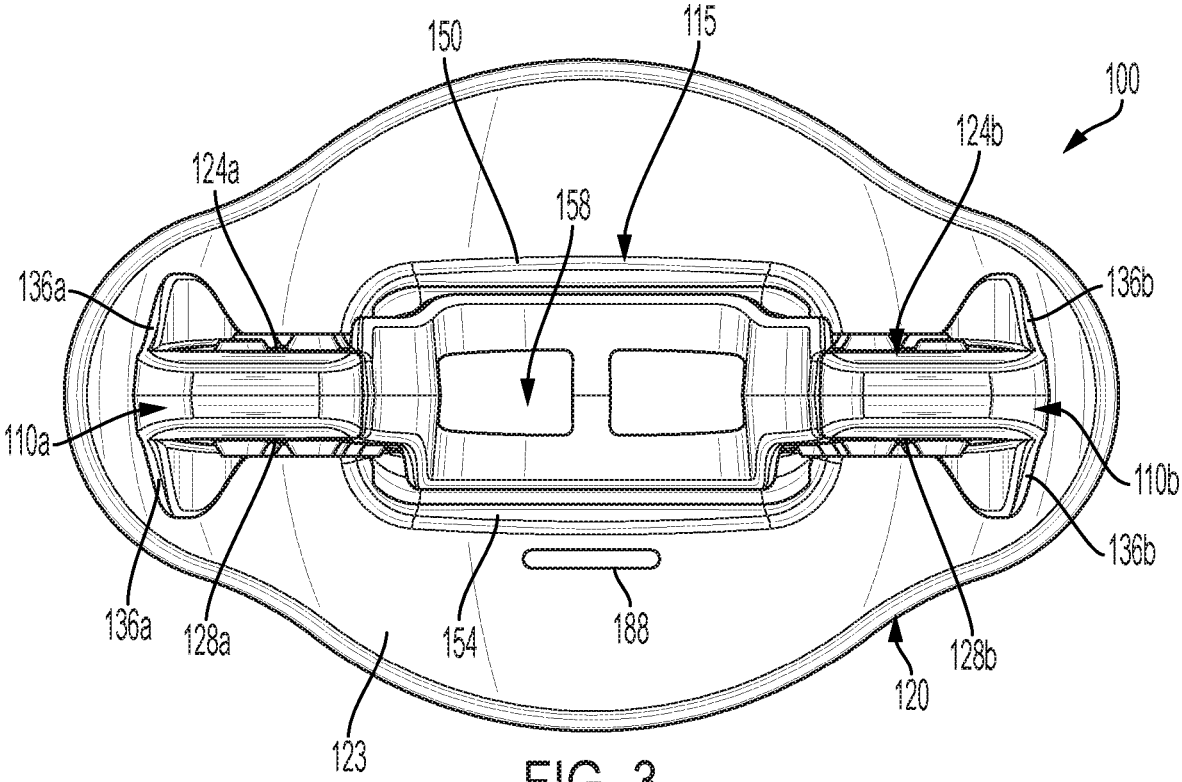
FIG. 3 is a rear view of the mouthguard of FIG. 1, according to some embodiments.
Figure 4:
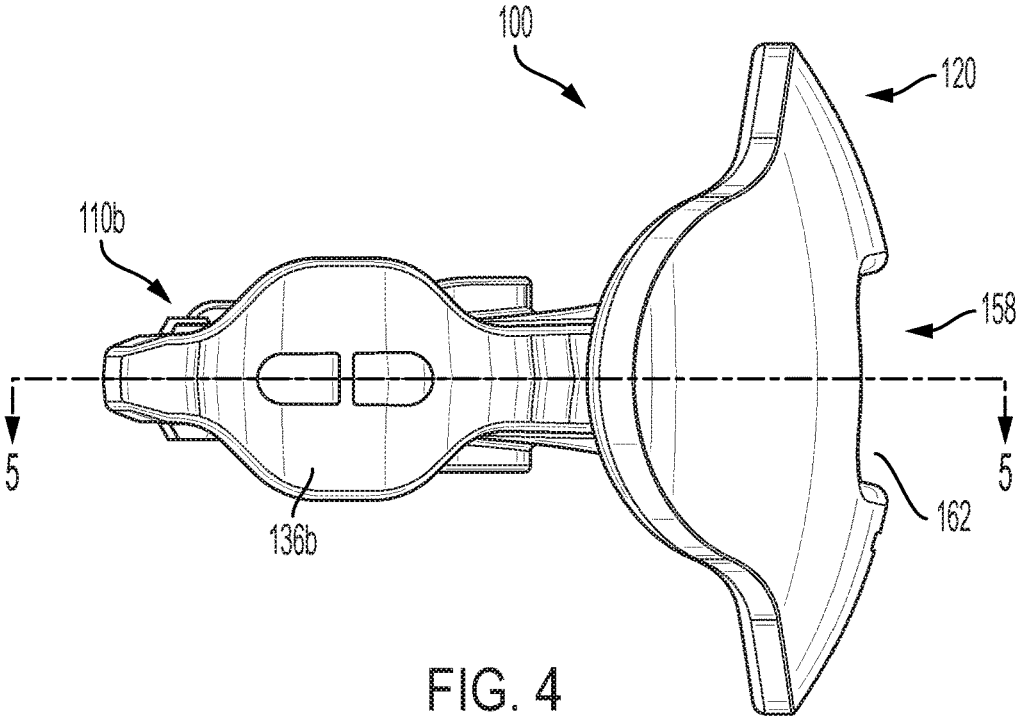
FIG. 4 is a side elevation view of the mouthguard of FIG. 1, according to some embodiments.

It should be understood that the drawings are intended facilitate understanding of exemplary embodiments of the present invention are not necessarily to scale.

DETAILED DESCRIPTION

The following description refers to the accompanying drawings which show specific embodiments. Although specific embodiments are shown and described, it is to be understood that additional or alternative features are employed in other embodiments. The following detailed description is not to be taken in a limiting sense, and the scope of the claimed invention is defined by the appended claims and their equivalents.

It should be understood that like reference numerals are intended to identify the same structural components, elements, portions, or surfaces consistently throughout the several drawing figures, as such components, elements, portions, or surfaces may be further described or explained by the entire written specification, of which this detailed description is an integral part. Unless otherwise indicated, the drawings are intended to be read (for example, cross-hatching, arrangement of parts, proportion, degree, etc.) together with the specification, and are to be considered a portion of the written description. In the description, the terms "forward", "front", "rearward", "rear", "upper", "lower", "forward", "rearward", "lateral", and "horizontal" as well as variations thereof (for example, "superiorly" and the like) are used to describe relative positions of features of mouthguards. Such terms refer to anatomical reference directions when a mouthguard is positioned in a wearer's mouth in a typical orientation.

FIGS. 1-8 illustrate a mouthguard 100, according to some embodiments. Generally, the mouthguard 100 includes a pair of spaced-apart lateral bite wings 110*a*, 110*b*, a conduit 115 having a forward end 116 and a rearward end 118, and a lip shield member 120 having a front face 122 and a rear face 123. As shown, the lateral bite wings 110*a*, 110*b* define, respectively, upper teeth-engaging surfaces 124*a*, 124*b*, and lower teeth-engaging surfaces 128*a*, 128*b*, and have respective forward portions 130*a*, 130*b* and opposite rearward portions 132*a*, 132*b*. As further shown, the conduit 115 is disposed between the forward portions 130*a*, 130*b* of the lateral bite wings 110*a*, 110*b*, and the lip shield member 120 is disposed about and extends radially outward with respect to the forward end 116 of the conduit 115.

In the illustrated embodiment, the lateral bite wings 110*a*, 110*b* include, respectively, border portions 134*a*, 134*b* disposed along the outer periphery thereof. As further illustrated, in this embodiment, the border portions 134*a*, 134*b* include, respectively, upper side walls 136*a*, 136*b* that project upward with respect to the upper teeth-engaging surfaces 124*a*, 124*b*, and lower side walls 137*a*, 137*b* that project downward with respect to the lower teeth-engaging surfaces 128*a*, 128*b*. In the particular mouthguard 100 the border portions 134*a*, 134*b* are structurally different elements than the lateral bite wings 110*a*, 110*b* (e.g., are formed in a separate manufacturing step, as will be explained in further detail herein), in other embodiments, the lateral bite wings 110*a*, 110*b* may lack distinct border portions 134*a*, 134*b*. In such embodiments, the upper and lower side walls 136*a*, 136*b*, and 137*a*, 137*b* may be integrally formed with the lateral bite wings 110*a*, 110*b*, respectively. Still alternatively, the upper side walls 136*a*, 136*b*, and/or the lower side walls 137*a*, 137*b* may be omitted.

As further shown, in the illustrated embodiment, the mouthguard 100 includes an upper rim 140 and a lower rim 142, as well as protrusions 144. As illustrated, the upper rim 140 extends upward with respect to the upper teeth engaging surfaces 124*a*, 124*b* along the rearward end 118 of the conduit 115 and portions of the inner edges of the lateral bite wings 110*a*, 110*b*. Additionally, the lower rim 142 extends downward with respect to the lower teeth engaging surfaces 128*a*, 128*b* along the rearward end 118 of the conduit 115 and portions of the inner edges of the lateral bite wings 110*a*, 110*b*. Still additionally, the protrusions 144 are formed on the upper and lower teeth engaging surfaces 124*a*, 124*b* and 128*a*, 128*b*.

When present, the upper and lower side walls 136*a*, 136*b*, and 137*a*, 137*b*, and the upper and lower rims 140, 142, can operate to enhance the fit of the mouthguard 100 and to maintain the mouthguard 100 in place in the wearer's mouth when in use. Additionally, the protrusions 144 can operate to enhance engagement between the teeth engaging surfaces 124*a*, 124*b*, 128*a*, 128*b* and the user's teeth. It is emphasized, however, that in various embodiments, any or all of the side walls 136*a*, 136*b*, and 137*a*, 137*b*, the upper and lower rims 140, 142 and the protrusions 144 may be omitted.

The conduit 115 has an upper wall 150 disposed generally upward of the lateral bite wings 110*a*, 110*b*, and a lower wall 154 disposed generally downward of the lateral bite wings 110*a*, 110*b*. As shown, the upper and lower walls 150, 154 extend between the forward and rearward ends 116, 118 of the conduit 115. The conduit 115 defines an air channel 158 having a front opening 162 at the forward end 116 of the conduit 115, and a rear opening 164 at the rearward end 118 of the conduit 115.

In the embodiment shown, the upper wall 150 defines an upper incisor engaging surface 170 located proximate the rearward end 118 of the conduit 115, and the lower wall 154 defines a lower incisor engaging surface 174 located proximate the rearward end 118 of the conduit 115. Additionally, the upper wall 150 further defines an upper lip engaging surface 180 between the upper incisor engaging surface 170 and the forward end 116 of the conduit, and the lower wall 154 defines a lower lip engaging surface 184 between the lower incisor engaging surface 174 and the forward end 116 of the conduit 115.

In the various embodiments, the upper and lower walls 150, 154 of the conduit 115 are arranged to taper inward from the forward end 116 toward the rearward end 118 of the conduit 115. As such, the distance between the upper and lower walls 150, 154 at the forward end 116 of the conduit 115 is greater than the corresponding distance between the upper and lower walls 150, 154 at the rearward end 118 of the conduit 115. Consequently, as can be seen in particular in FIG. 8, the front opening 162 of the air channel 158 has a larger cross-sectional area than the rear opening 164 of the air channel 158.

Figure 5:
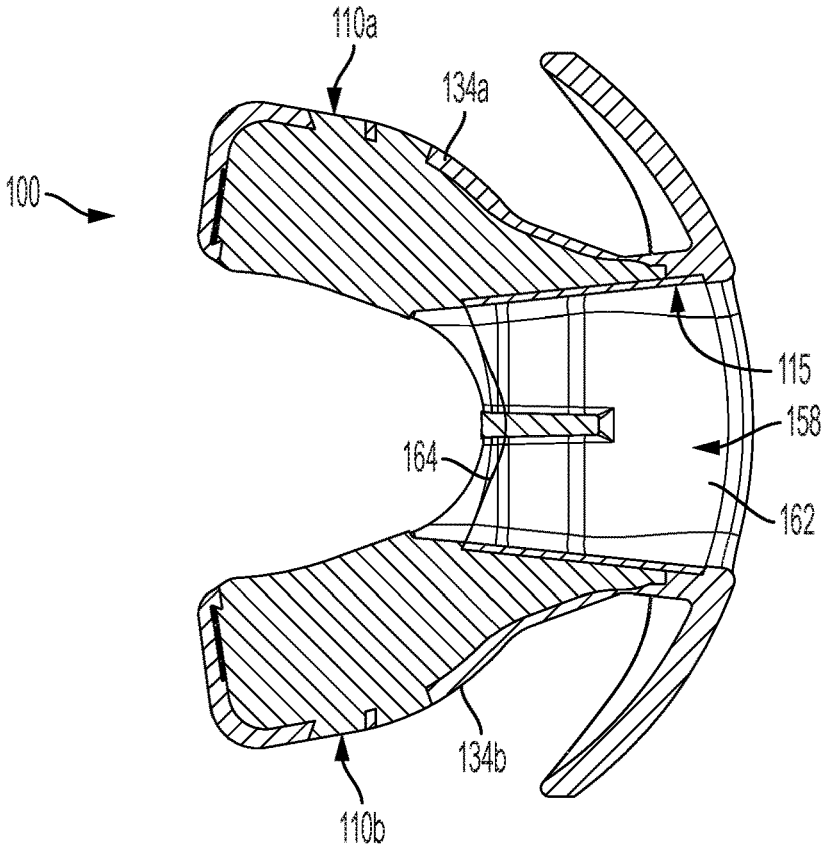
FIG. 5 is a top sectional view of the mouthguard of FIG. 1 taken along the line 5-5 in FIG. 4, according to some embodiments.
Figure 6:
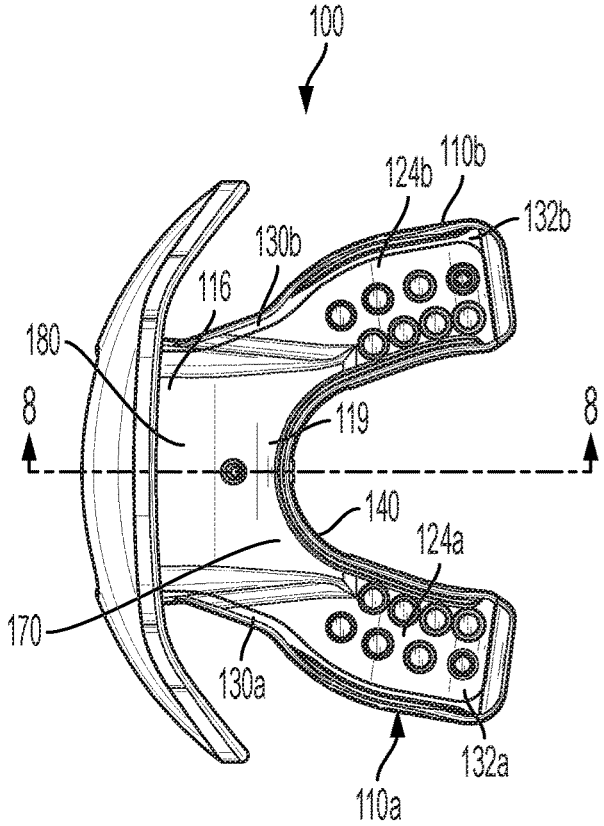
FIG. 6 is a top view of the mouthguard of FIG. 1, according to some embodiments.
Figure 7:
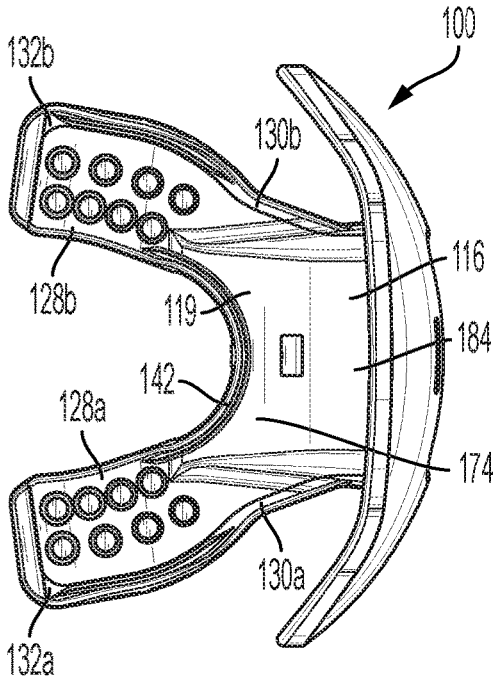
FIG. 7 is a bottom view of the mouthguard of FIG. 1, according to some embodiments.

Additionally, in some embodiments, as can be seen best in FIG. 5, the air channel 158 is wider at the front opening 162 than at the rear opening 164. In other embodiments, the air channel 158 has a substantially constant lateral-direction width between the front opening 162 and the rear opening 164.

In the illustrated embodiment, the conduit 115 includes an interior wall 186 extending from the lower wall 154 to the upper wall 150 within the air channel 158. In the particular embodiment shown, the interior wall 186 extends from the rearward end 118 of the conduit 115 (and consequently, from the rear opening 164 of the air channel 158) forward toward the forward end 116 of the conduit 115. As such, in this embodiment, the inner wall 186 is positioned to bifurcate the rearward region of the air channel 158. In other embodiments, the interior wall 186 may extend substantially the entire length of the conduit 115 and the air channel 158 (effectively forming two discrete air channels). In other embodiments, additional interior walls may be present. In still other embodiments, the interior wall 186 may be omitted altogether. When present, the interior wall 186 operates to provided structural support to the conduit 115, thereby inhibiting crushing of the conduit 115 during use.

The lip shield member 120 can have various possible sizes and shapes, and is configured to protect the soft tissues surrounding the mouth from frontal blows. In the various embodiments, the rear face 123 is positioned and shaped to generally confront the outer surface of the wearer's lips when in use, while the front face 122 is oriented to face away from the wearer's lips when in use.

In the illustrated embodiment, the lip shield member 120 includes a slot 188 for receiving a tether (not shown), which may be secured to a facemask or other feature of a helmet. In other embodiments, the slot 188 may be omitted.

In various embodiments, the mouthguard 100 may be a composite, multi-layer construction, with different portions/layers formed in different manufacturing processes or steps, and in some embodiments, of different polymer compositions. Such composite construction advantageously provides the ability to tailor the mechanical or other functional properties of the respective portions of mouthguard 100.

Figure 8:
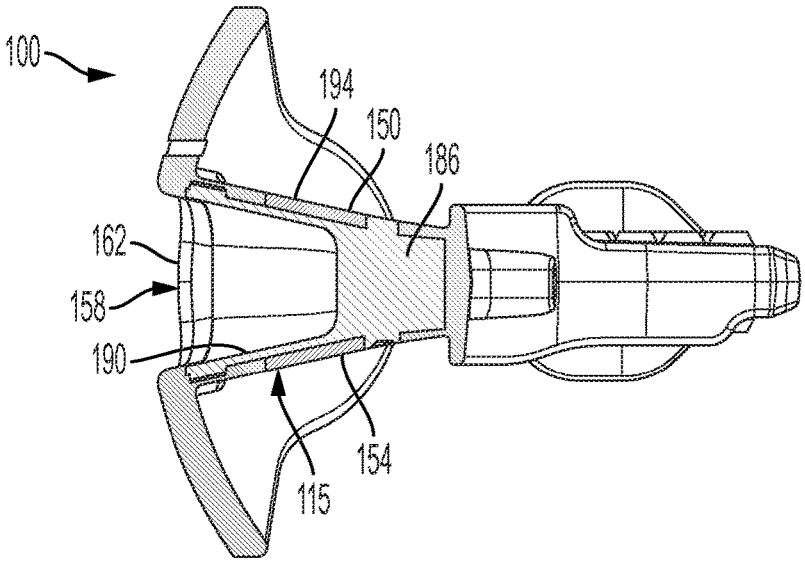
FIG. 8 is a side sectional view of the mouthguard of FIG. 1 taken along line 8-8 of FIG. 6, according to some embodiments.

In the illustrated embodiment, as can perhaps be best seen in FIGS. 5 and 8, the conduit 115 is a multi-layer construction, and includes a core layer 190 that generally defines the tapered geometry of the conduit 115 and the air channel 158. Surrounding the core layer 190 is an outer layer 194. In one embodiment, the core layer 190 may be made from a higher-durometer material than the outer layer 194.

In various embodiments of the mouthguard 100, the lateral bite wings 110*a*, 110*b* may be formed integrally with, and consequently, of the same material as, the outer layer 194 of the conduit 115. In other embodiments, the lateral bite wings 110*a*, 110*b* may be formed after forming the outer layer 194 of the conduit 115. Similarly, in embodiments, the lip shield member 120 may be formed integrally with the lateral bite wings 110*a*, 110*b*.

In other embodiments, the lip shield member 120 may be formed in a separate process from the formation of the conduit 115 and/or the lateral bite wings 110*a*, 110*b*. In one embodiment, the lip shield member 120 comprises a third material that is different, in composition and/or hardness, than the material(s) forming the conduit 115 and/or the lateral bite wings 110*a*, 110*b*.

In still other embodiments, the border portions 134*a*, 134*b* and/or the side walls 136*a*, 136*b*, when present, may be formed in the same manufacturing step, and consequently, of the same material, as the lip shield member 130. In other embodiments, the lateral bite wings 110*a*, 110*b* lack structurally separate border portion. In such embodiments, the side walls 136*a*, 136*b* when present, can be formed in the same manufacturing step as the lateral bite wings 110*a*, 110*b*, and thus be made of the same material.

The multi-layer, multi-element construction of various embodiments of the mouthguard 100 advantageously provides for tailoring the various elements to provide desired functional benefits. In such embodiments, the relative rigidity of the core layer 190 can provide robust mechanical strength so as to maintain the patency of the air channel 158 when in use. At the same time, in embodiments, the outer layer 194 can be formed from a relatively softer material to improve mouth feel and general wearability of the mouthguard 100.

For example, in one embodiment, the material of the core layer 190 may be material having a durometer in the range of 40-70, and the outer layer 194 may be formed of a material having a Shore A durometer in the range of 40-70 but having a different durometer than that of the core layer material. In one embodiment, the material of the core layer 190 has a Shore A durometer of about 65, and the material of the outer layer has a Shore A durometer of about 55. In some embodiments, a ratio of the durometer of the outer layer 194 material to the core layer 190 material may be between about 80 percent and 90 percent. In the various embodiments, the core layer 190 and outer layer 194 may be made of materials of completely different compositions, whereas in other embodiments the respective layers may be made of the same general material class but have different hardness characteristics.

In some embodiments, the core layer material may be a composite of a copolymer of ethylene and vinyl acetate (EVA), such as the Elvax™ resins commercially available from Ashland Chemical Company, and an elastomeric material such as thermoplastic rubber or vulcanized rubber. In some embodiments, the core layer material includes about 50 percent to about 80 percent by weight of the elastomeric material and about 20 percent to about 50 percent by weight of the copolymer of EVA. In some embodiments, the EVA copolymer can include vinyl acetate in the range of about 18 percent to about 28 percent by weight. In some embodiments, the core layer material is thermoplastic rubber marketed under the trademark KRATON™, which is marketed by GLS Plastics of 740B Industrial Drive, Cary, Ill. 60013. This thermoplastic rubber is unique in that it is injection moldable, FDA approved, and readily adheres with copolymers of EVA. Furthermore, the thermoplastic rubber has a melting or softening point significantly higher than that of EVA.

In various embodiments, the outer layer material is 100 percent of a copolymer of ethylene and vinyl acetate, and has at least 33 percent of vinyl acetate by weight. In various embodiments, the second material includes a copolymer of ethylene and vinyl acetate, and has at least 40 percent of vinyl acetate by weight. For example, a suitable such material is a soft EVA 40. Alternatively, another suitable material includes EVA 100. In some embodiments, the outer layer material is a suitably soft thermoplastic rubber having a durometer low enough so that the mouthguard 100 does not have to be molded to the wearer's teeth.

In some embodiments, the mouthguard 100 is a boil and bite mouthguard 100. For example, the mouthguard 100 is formed of one or more materials that soften at a temperature in the range of about 100 to about 150 degrees Fahrenheit, and the mouthguard 100 is molded to the wearer's teeth after raising the mouthguard 100 to such a temperature, for example, by immersing the mouthguard 100 in boiling water. In some embodiments, the mouthguard 100 is molded to the wearer's teeth at room temperature.

In some embodiments, the mouthguard 100 includes one or more flavoring compounts. Such flavoring compounds may include, for example, flavoring oils or sweeteners, or combinations thereof. For example, in one embodiment, the material of the lateral bite wings 110*a*, 110*b* and/or the conduit 115 may include a flavoring compound blended throughout. Furthermore, in embodiments in which the mouthguard 100 is a multi-layer construction, the various flavoring compounds can be selectively included in different layers/components to facilitate manufacturability and/or improve the taste-enhancing function of the mouthguard 100.

In one embodiment, a flavoring oil is blended into the material forming the outer layer 194 of the conduit 115 and the lateral bite wings 110*a*, 110*b*, while keeping these layers free of sweeteners, while a sweetener, but not a flavoring oil, is blended throughout the material forming the core layer 190. In another embodiment, this arrangement is reversed, e.g., a sweetener-free flavoring oil is blended into the material forming the core layer 190, and one or more sweeteners alone (i.e., without any other flavoring compound) is blended into the material forming the outer layer 194 of the conduit 115 and the lateral bite wings 110*a*, 110*b*.

Figure 9:
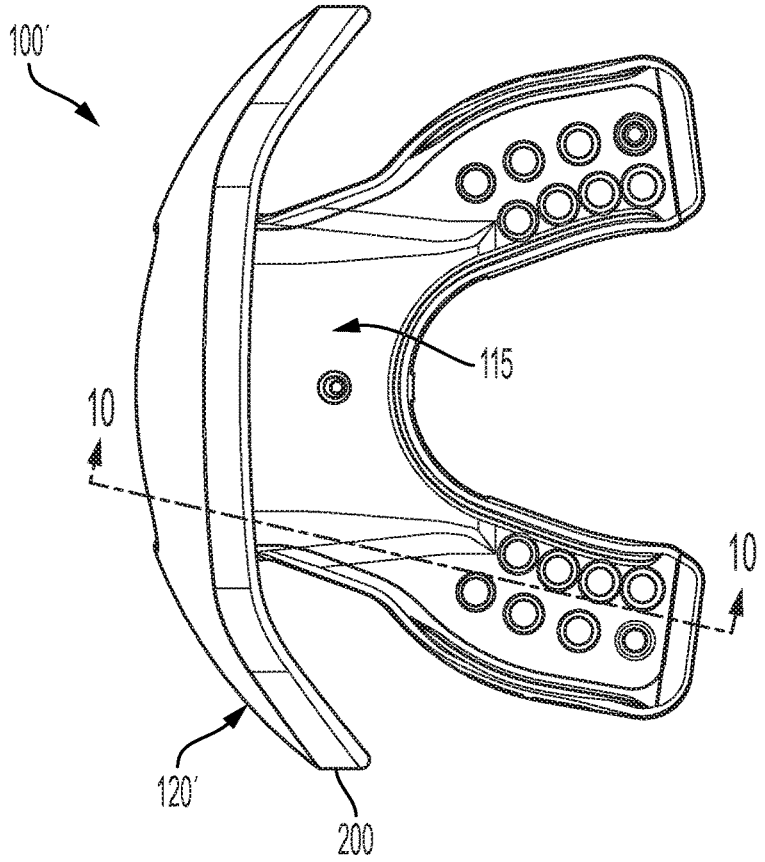
FIG. 9 is a top view of an alternative mouthguard, according to some embodiments.
Figure 10:
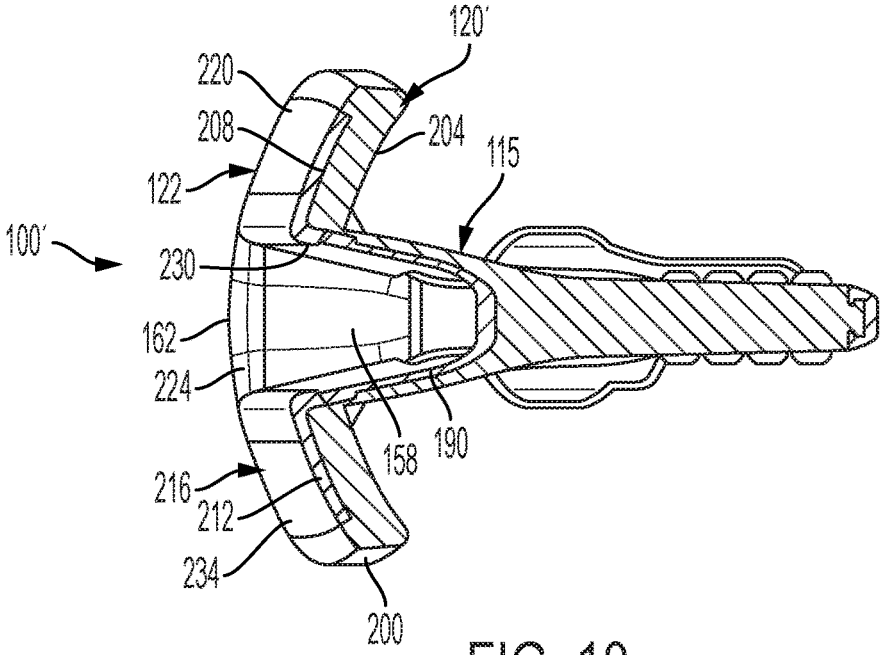
FIG. 10 is a side sectional view of the mouthguard of FIG. 9 taken along line 10-10 of FIG. 9, according to some embodiments.
Figure 11:
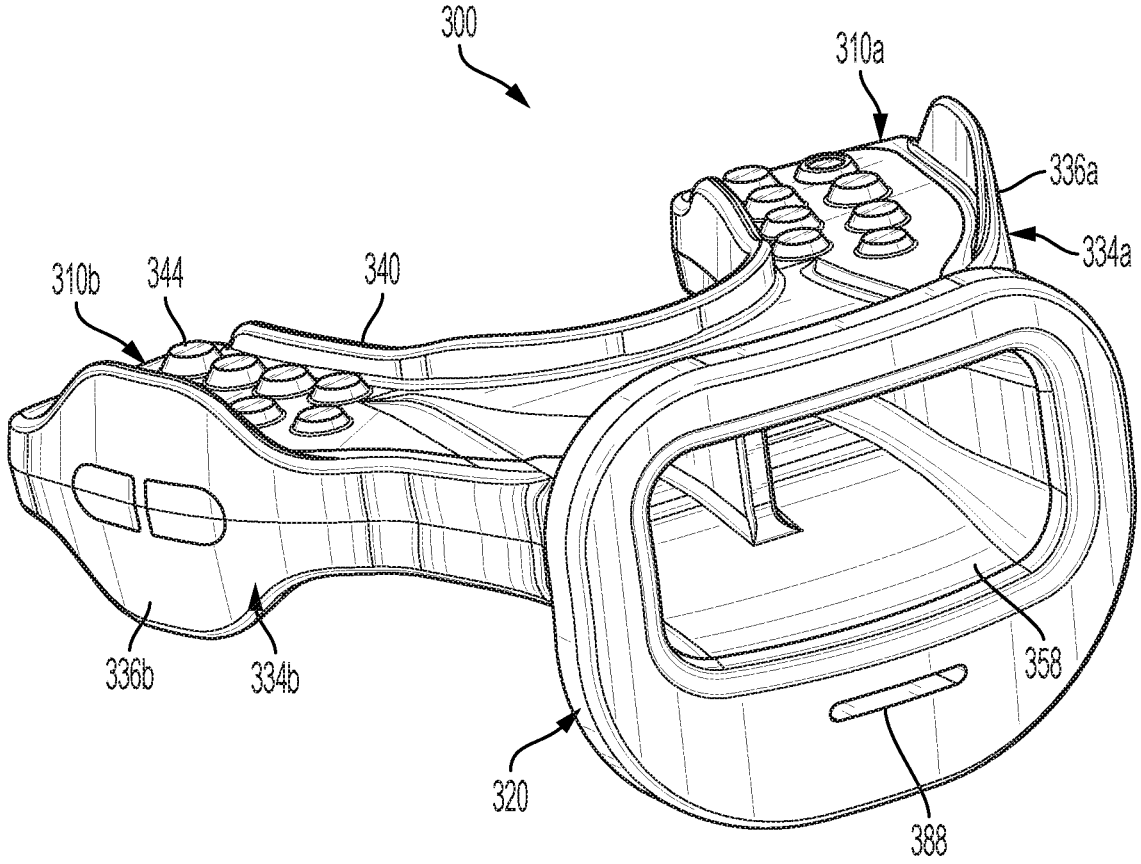
FIG. 11 is a front perspective view of a mouthguard, according to some alternative embodiments.
Figure 12:
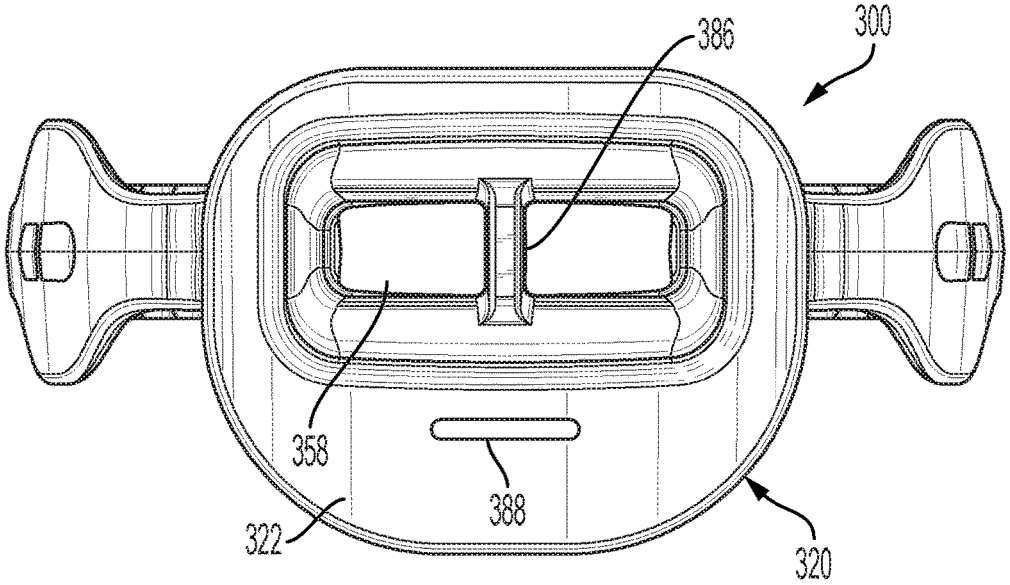
FIG. 12 is a front view of the mouthguard of FIG. 11, according to some embodiments.
Figure 13:
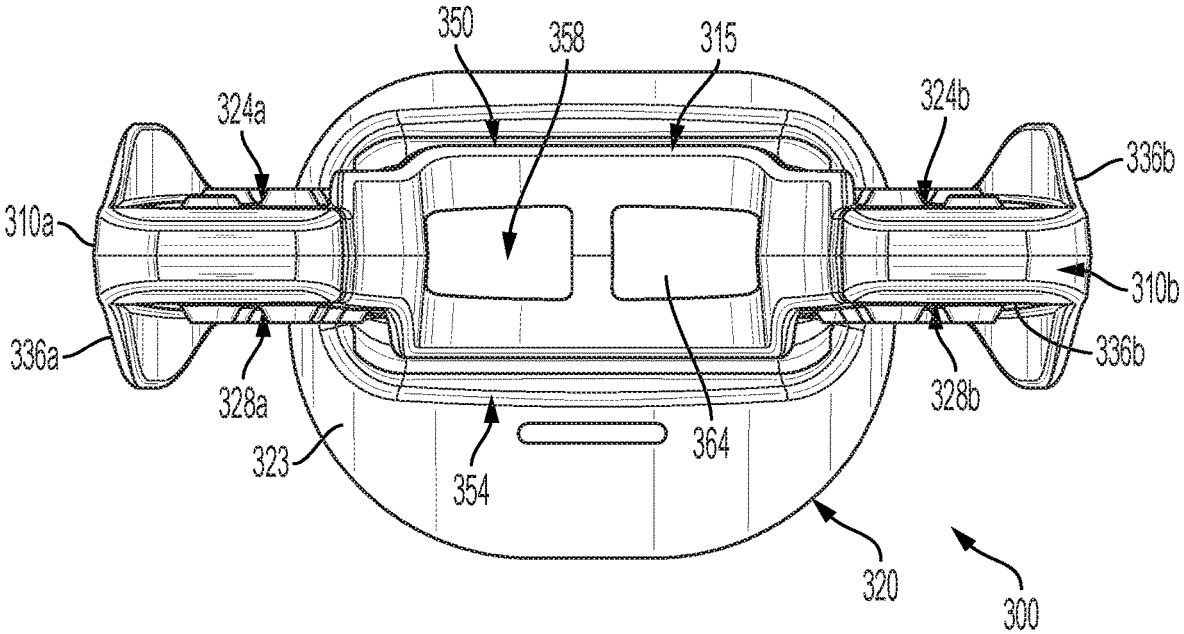
FIG. 13 is a rear view of the mouthguard of FIGS.
Figure 14:
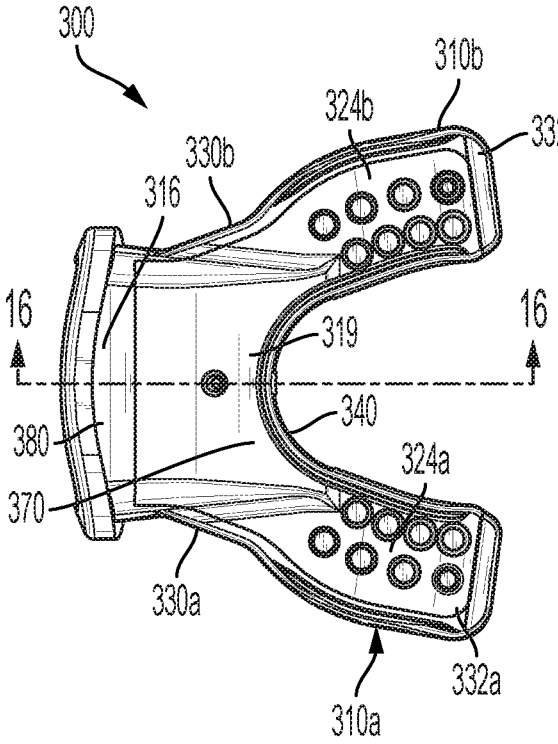
FIG. 14 is a top view of the mouthguard of FIGS.
Figure 15:
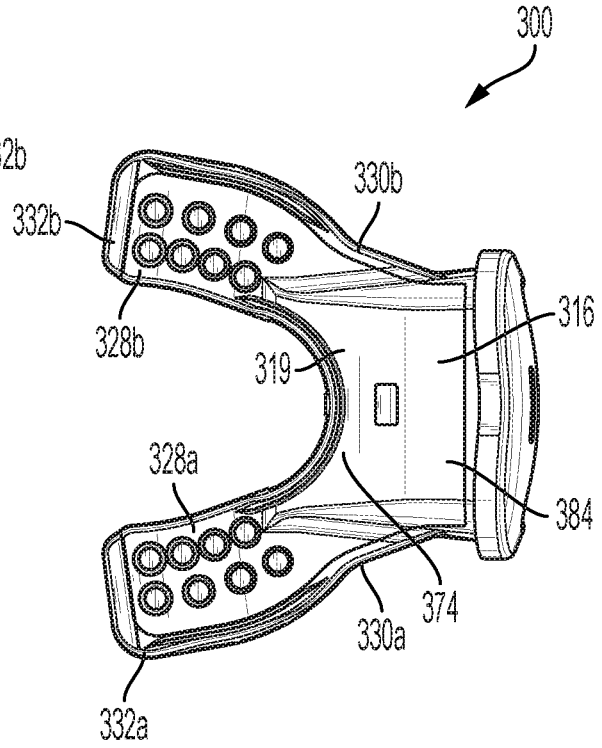
FIG. 15 is a bottom view of the mouthguard of FIGS.

FIGS. 9-10 are plan and sectional elevation views, respectively, of an alternative mouthguard 100' according to another embodiment. Except as described herein, the mouthguard 100' is substantially the same in construction as the multi-layer embodiments of the mouthguard 100 described previously. As can be seen in FIGS. 9-10, however, the mouthguard 100' has a composite lip shield member 120' that includes a support wall 200 having a rear surface 204 (that corresponds to the rear face 123 of the lip shield member 120 in the mouthguard 100), and a front surface 208. In the illustrated embodiment, the front surface 208 of the support wall 200 also includes a recessed region 212.

The lip shield member 120' further includes a preform 216 secured to the support wall 200. The preform 216 is a structurally separate component that is pre-fabricated in a predetermined shape and secured to the support wall 200 in a separate manufacturing step from the formation of the support wall 200. In the illustrated embodiment, the preform 216 includes a preform wall 220, a preform opening 224 and a preform projection 230 extending rearward from the preform wall 220 around an inner periphery of the preform opening 224. Additionally, the preform wall 220 defines a forward-facing outer surface 234. As shown, the preform opening defines the front opening 162 of the air channel 158. Additionally, the outer surface 234 partially defines the front face 122 of the lip shield member 120'.

As can be seen in FIG. 10, in the particular embodiment illustrated, the preform wall 220 is shaped and positioned to generally conform to the front surface 208 of the support wall 200. Additionally, in the illustrated embodiment, the preform wall 220 is disposed within the recessed region 212 of the support wall 200, and the preform projection 230 extends rearwardly to generally abut a forward end of the core layer 190 of the conduit 115. Positioning the preform wall 220 within the recessed region 212 can operate to provide a mechanical interlock between the preform 216 and the support wall 200. In other embodiments, however, the front surface 208 of the support wall 200 lacks the recessed region 212, and the preform wall 220 extends over the entire forward extent of the support wall 200.

The particular mechanical properties of the preform 216 can be tailored as desired. In one embodiment, the preform has substantially comparable flexibility to the support wall 200. In other embodiments, the preform 216 can be formed of a relatively rigid material as compared to the support wall 200. In various embodiments, the use of the preform 216 advantageously allows for improved manufacturing of designs into the front face 122 of the lip shield member 120'. For example, the preform 216 can be formed of a material that readily accepts printed designs and/or surface treatments (e.g., chrome-like surfaces and the like), particularly as compared to the materials making up the support wall 200 or other components of the mouthguard 100'. In one such embodiment, the preform can be made from polypropylene or polycarbonate. It is emphasized, however, that these materials are exemplary only, and that the skilled artisan will recognize that other suitable materials may be used.

In embodiments, the preform 216 can be secured to the support wall 200 and the conduit 158 by an adhesive. In other embodiments, the preform 216 can be mechanically bonded to the support wall 200 and other components of the mouthguard 100' by a covalent bond between these components, through appropriate material selection. In still other embodiments, the preform 216 can be mounted into the molding apparatus prior to formation of the support wall 200, and the support wall 200 may be subsequently overmolded to the preform 216. As will be appreciated, the particular manufacturing process or steps utilized to form and/or assemble the mouthguard 100' are not critical to the overall design and functionality thereof.

FIGS. 11-16 illustrate, collectively, embodiments of an alternative mouthguard 300, that is in many respects similar or identical to the mouthguards 100, 100' described herein. As such, the skilled artisan will understand that various components of the mouthguard 300 can be configured and formed in substantially the same manner as the corresponding elements of the mouthguards 100, 100', except where specifically described in connection with the mouthguard 300.

As shown in FIGS. 11-16, collectively, the mouthguard 300 includes a pair of spaced-apart lateral bite wings 310*a*, 310*b*, a conduit 315 having a forward end 316 and a rearward end 318, and a flange 320 having a front face 322 and a rear face 323. As shown, the lateral bite wings 310*a*, 310*b* define, respectively, upper teeth-engaging surfaces 324*a*, 324*b*, and lower teeth-engaging surfaces 328*a*, 328*b*, and have respective forward portions 330*a*, 330*b* and opposite rearward portions 332*a*, 332*b*. As further shown, the conduit 315 is disposed between the forward portions 330*a*, 330*b* of the lateral bite wings 310*a*, 310*b*, and the flange 320 is disposed about and extends radially outward with respect to the forward end 316 of the conduit 315.

In the illustrated embodiment, the lateral bite wings 310*a*, 310*b* include, respectively, border portions 334*a*, 334*b* disposed along the outer periphery thereof. As further illustrated, in this embodiment, the border portions 334*a*, 334*b* include, respectively, upper side walls 336*a*, 336*b* that project upward with respect to the upper teeth-engaging surfaces 324*a*, 324*b*, and lower side walls 337*a*, 137*b* that project downward with respect to the lower teeth-engaging surfaces 328*a*, 328*b*. In the particular mouthguard 300 the border portions 334*a*, 334*b* are structurally distinct elements than the lateral bite wings 310*a*, 310*b* (e.g., are formed in a separate manufacturing step, as will be explained in further detail herein), in other embodiments, the lateral bite wings 310*a*, 310*b* may lack distinct border portions 334*a*, 334*b*. In such embodiments, the upper and lower side walls 336*a*, 336*b*, and 337*a*, 337*b* may be integrally formed with the lateral bite wings 310*a*, 310*b*, respectively. Still alternatively, the upper side walls 336*a*, 336*b*, and/or the lower side walls 337*a*, 337*b* may be omitted.

As further shown, in the illustrated embodiment, the mouthguard 300 includes an upper rim 340 and a lower rim 342, as well as protrusions 344. As illustrated, the upper rim 340 extends upward with respect to the upper teeth engaging surfaces 324*a*, 324*b* along the rearward end 318 of the conduit 315 and portions of the inner edges of the lateral bite wings 310*a*, 310*b*. Additionally, the lower rim 342 extends downward with respect to the lower teeth engaging surfaces 328*a*, 328*b* along the rearward end 318 of the conduit 315 and portions of the inner edges of the lateral bite wings 310*a*, 310*b*. Still additionally, the protrusions 344 are formed on the upper and lower teeth engaging surfaces 324*a*, 324*b* and 328*a*, 328*b*.

When present, the upper and lower side walls 336*a*, 336*b*, and 337*a*, 337*b*, and the upper and lower rims 340, 342, can operate to enhance the fit of the mouthguard 300 and to maintain the mouthguard 300 in place in the wearer's mouth when in use. Additionally, the protrusions 344 can operate to enhance engagement between the teeth engaging surfaces 324*a*, 324*b*, 328*a*, 328*b* and the user's teeth. It is emphasized, however, that in various embodiments, any or all of the side walls 336*a*, 336*b*, and 337*a*, 337*b*, the upper and lower rims 340, 342 and the protrusions 344 may be omitted.

The conduit 315 has an upper wall 350 disposed generally upward of the lateral bite wings 310*a*, 310*b*, and a lower wall 354 disposed generally downward of the lateral bite wings 310*a*, 310*b*. As shown, the upper and lower walls 350, 354 extend between the forward and rearward ends 316, 318 of the conduit 315. The conduit 315 defines an air channel 358 having a front opening 362 at the forward end 316 of the conduit 315, and a rear opening 364 at the rearward end 318 of the conduit 315.

In the embodiment shown, the upper wall 350 defines an upper incisor engaging surface 370 located proximate the rearward end 318 of the conduit 315, and the lower wall 354 defines a lower incisor engaging surface 374 located proximate the rearward end 318 of the conduit 315. Additionally, the upper wall 350 further defines an upper lip engaging surface 380 between the upper incisor engaging surface 370 and the forward end 316 of the conduit, and the lower wall 354 defines a lower lip engaging surface 384 between the lower incisor engaging surface 374 and the forward end 116 of the conduit 315.

In the various embodiments, the upper and lower walls 350, 354 of the conduit 315 are arranged to taper inward from the forward end 316 toward the rearward end 318 of the conduit 315. As such, the distance between the upper and lower walls 350, 354 at the forward end 316 of the conduit 315 is greater than the corresponding distance between the upper and lower walls 350, 354 at the rearward end 318 of the conduit 315. Consequently, as can be seen in particular in FIG. 16, the front opening 362 of the air channel 358 has a larger cross-sectional area than the rear opening 364 of the air channel 158.

In the illustrated embodiment, the conduit 315 includes an interior wall 386 extending from the lower wall 354 to the upper wall 350 within the air channel 358. In the particular embodiment shown, the interior wall 386 extends from the rearward end 318 of the conduit 315 (and consequently, from the rear opening 364 of the air channel 358) forward toward the forward end 316 of the conduit 315. As such, in this embodiment, the inner wall 386 is positioned to bifurcate the rearward region of the air channel 358. In other embodiments, the interior wall 386 may extend substantially the entire length of the conduit 315 and the air channel 358 (effectively forming two discrete air channels). In other embodiments, additional interior walls may be present. In still other embodiments, the interior wall 386 may be omitted altogether. When present, the interior wall 386 operates to provided structural support to the conduit 315, thereby inhibiting crushing of the conduit 115 during use.

In the illustrated embodiment, the flange 320 includes a slot 388 for receiving a tether (not shown), which may be secured to a facemask or other feature of a helmet. In other embodiments, the slot 388 may be omitted.

Figure 16:
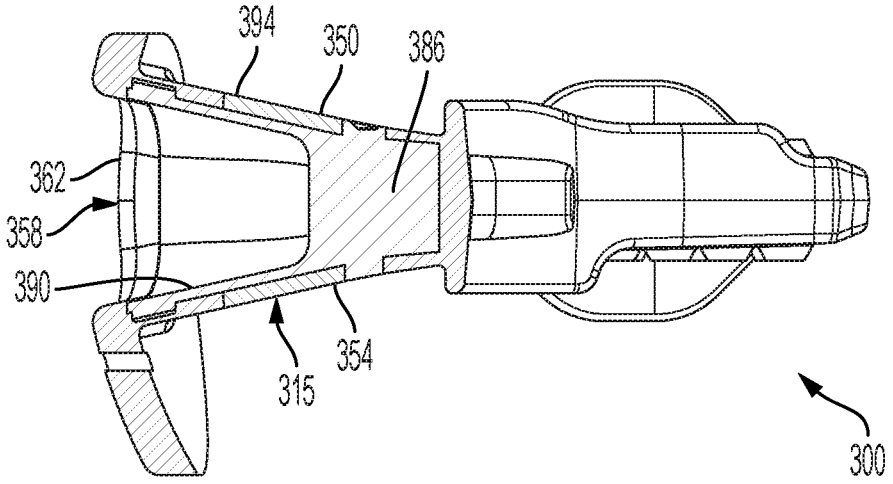
FIG. 16 is a side sectional view of the mouthguard of FIGS.

In the illustrated embodiment, as can perhaps be best seen in FIG. 16, the conduit 115 is a multi-layer construction, and includes a core layer 390 that generally defines the tapered geometry of the conduit 315 and the air channel 358. Surrounding the core layer 390 is an outer layer 394. In one embodiment, the core layer 390 may be made from a higher-durometer material than the outer layer 394.

From the foregoing, it will be understood by the skilled artisan that the mouthguard 300 differs from the mouthguards 100, 100' in that the mouthguard 300 includes the flange 320 in lieu of the lip shield members 120, 120'. The flange 320 can operate to provide radial strength to the forward end 316 of the conduit 315, and also provide for the inclusion of the tether slot 388, when desired. However, in various embodiments, the flange 320 may be omitted entirely.

Figure 17:
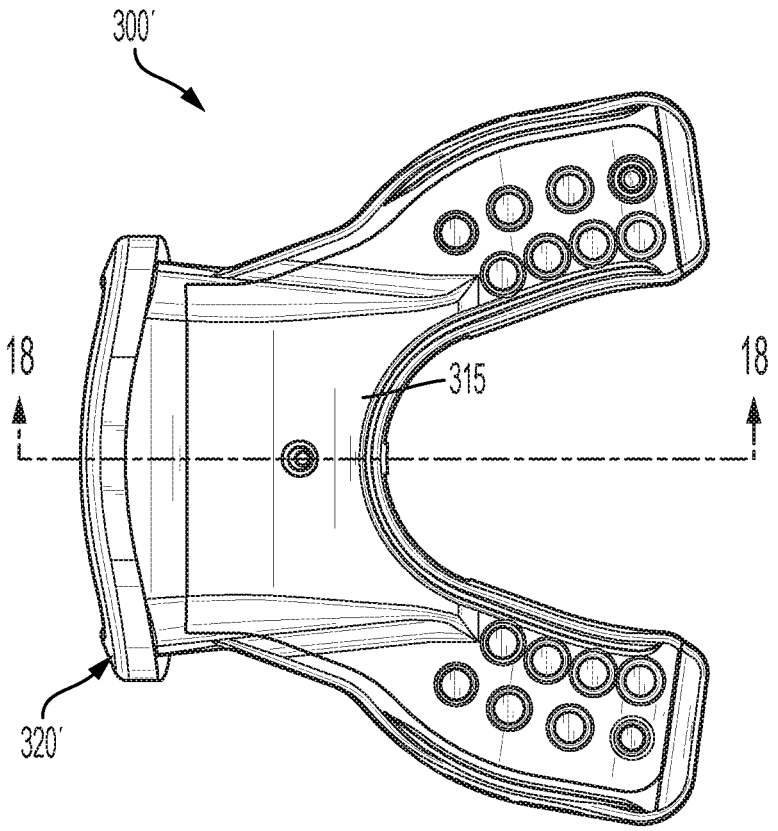
FIG. 17 is a top view of an alternative mouthguard, according to some embodiments.
Figure 18:
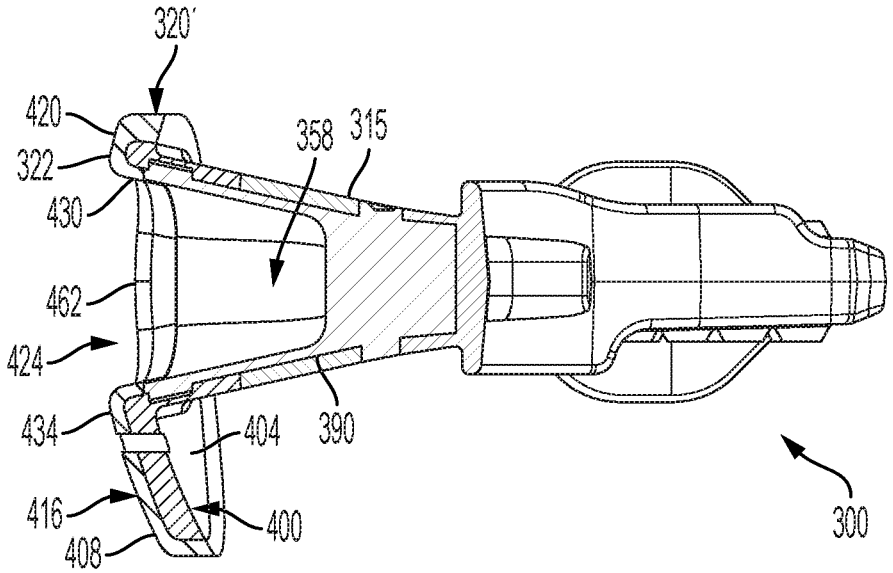
FIG. 18 is a side sectional view of the mouthguard of FIG. 17 taken along line 18-18 of FIG. 17, according to some embodiments.

FIGS. 17-18 are plan and sectional elevation views, respectively, of an alternative mouthguard 300' according to another embodiment. Except as described herein, the mouthguard 300' is substantially the same in construction as the multi-layer embodiments of the mouthguard 300 described previously. As can be seen in FIGS. 17-18, however, the mouthguard 300' has a composite flange 320' that includes a support wall 400 having a rear surface 404 (that corresponds to the rear face 323 of the flange 320 in the mouthguard 300), and a front surface 408.

The flange 320' further includes a preform 416 secured to the support wall 400. The preform 416 is a structurally separate component that is pre-fabricated in a predetermined shape and secured to the support wall 400 in a separate manufacturing step from the formation of the support wall 400. In the illustrated embodiment, the preform 416 includes a preform wall 420, a preform opening 424 and a preform projection 430 extending rearward from the preform wall 420 around an inner periphery of the preform opening 424. Additionally, the preform wall 420 defines a forward-facing outer surface 434. As shown, the preform opening defines the front opening 462 of the air channel 358. Additionally, the outer surface 434 defines the front face 322 of the flange 320'.

As can be seen in FIG. 18, in the particular embodiment illustrated, the preform wall 420 is shaped and positioned to generally conform to the front surface 408 of the support wall 400. Additionally, in the illustrated embodiment, the preform wall 420 extends over substantially the entire front surface 408 of the support wall 400, and the preform projection 430 extends rearwardly to generally abut a forward end of the core layer 390 of the conduit 315. In other embodiments, however, the preform wall 420 may be disposed within a recessed region of the front surface 408 of the support wall 400, similar to the configuration of the mouthguard 100' described herein.

Figure 19:
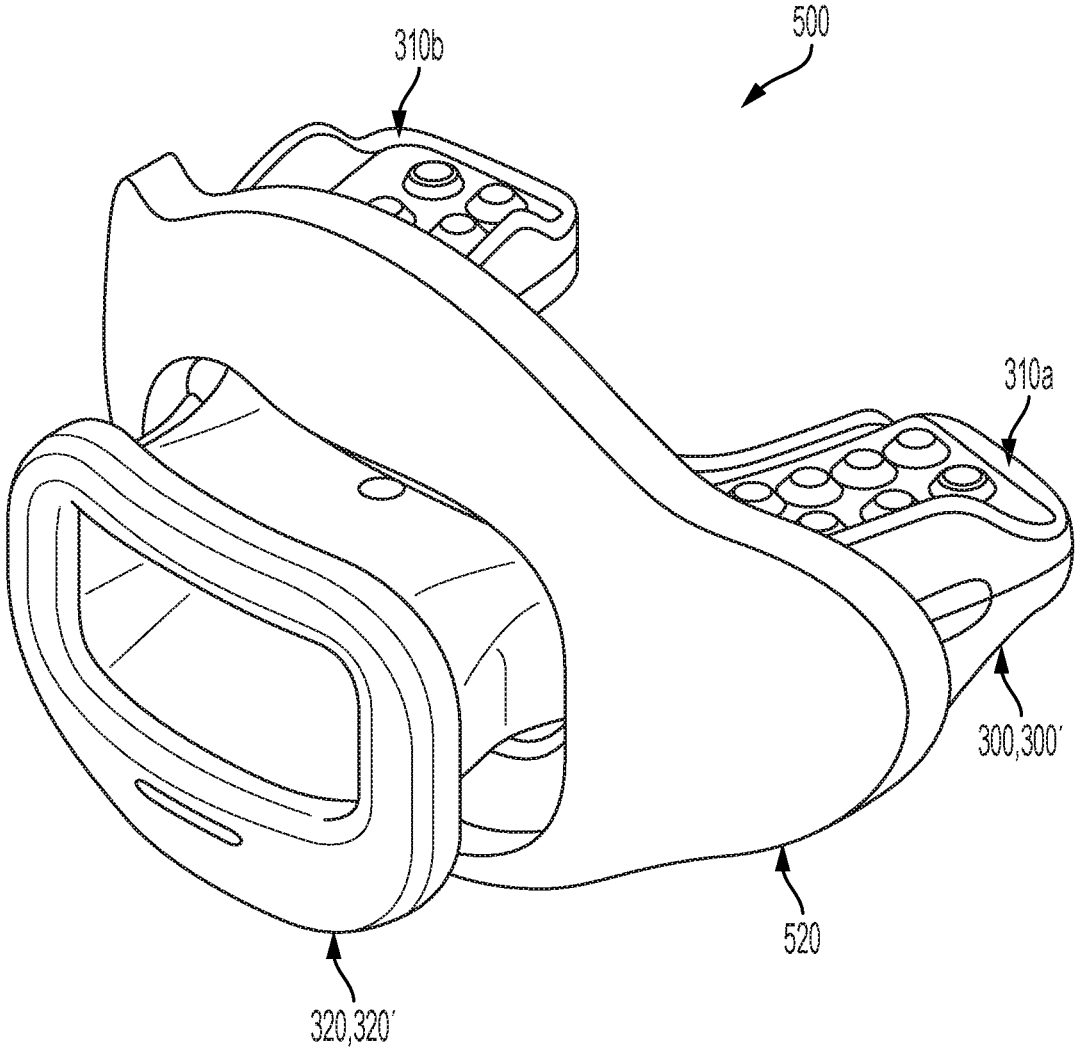
FIG. 19 is a front perspective view of another mouthguard, according to some embodiments.

FIG. 19 is a perspective view of an additional alternative mouthguard 500 according to various embodiments. As shown, the mouthguard 500 includes the mouthguard 300, 300' and a removable, interchangeable lip shield member 520, 520'. FIG. 19 shows the mouthguard 500 in a partially assembled state. The lip shield member 520 or 520', as the case may be, can be of substantially the same construction and design as the lip shield members 120, 120' described elsewhere herein, but can be separately assembled about the flange 320, 320' by the user, e.g., by urging the lateral bite wings 310*a*, 310*b* toward one another to allow the lip shield member 520, 520' to be slid into place and coupled to the flange 320, 320'. The lip shield member 520, 520' can subsequently be removed and a different lip shield member 520, 520' (e.g., with a different design imprinted thereon) can be installed.

Various methods and fabrication steps can be employed to form the mouthguards 100, 100', 300, 300' and 500. Generally speaking, the respective mouthguard elements described herein can be formed by conventional molding processes typically used for forming mouthguards and elements thereof.

In one embodiment of a multi-layer mouthguard 100, 100', 300, 300' or 500, the core layer can first be formed by a molding process. In one embodiment, the core layer may be molded in a first material having a first durometer. Thereafter, the outer layer may be molded over the core layer. In embodiments, the outer layer may be formed of a second material different than the first material. In one embodiment, the second material has a lower durometer than the first material. In other embodiments, the outer layer may be formed of the first material, but still formed in a separate step from the core layer.

In embodiments, the lateral bite wings can be formed by a molding process. The lateral bite wings may be molded in the same molding step as the outer layer and thus be formed of the same material as the outer layer. In other embodiments, the lateral bite wings may be formed subsequent to the forming of the outer layer, and of either the same or a different material.

In embodiments, the lip shield member or the flange, as the case may be, can be formed in the same molding process as the lateral bite wings and/or the outer layer of the conduit. In other embodiments, the lip shield member or flange is formed in a third molding step of a third material, which may have a different durometer from that of the outer layer of the conduit and/or the lateral bite wings.

In embodiments in which the lateral bite wings have structurally separate border portions, the border portions can be formed in a separate molding step. In one embodiment, the border portions are formed of the third material (i.e., the same material forming the lip shield member or the flange).

In embodiments of the mouthguard 100' or 300', the preform can be secured to the lip shield member or the flange, respectively. In other embodiments, the lip shield member or the flange can be overmolded about the preform.

In short, the multi-layer mouthguard embodiments allow for a wide range of manufacturing processes and steps.

Various other modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A mouthguard comprising:

a pair of spaced lateral bite wings, each having an upper teeth engaging surface, a lower teeth engaging surface, a forward portion and a rearward portion;

a conduit disposed between the forward portions of the lateral bite wings, the conduit having a forward end, a rearward end, and upper and lower walls extending between the forward and rearward ends of the conduit, the conduit defining an air channel extending therethrough from the forward end to the rearward end, the air channel having a front opening at the forward end of the conduit and a rear opening at the rearward end of the conduit;

wherein the conduit is tapered inward from the forward end to the rearward end thereof such that a distance between the upper and lower walls at the forward end is greater than a distance between the upper and lower walls at the rearward end, wherein the front opening of the air channel has a larger cross-sectional area than the rear opening of the air channel, wherein the upper wall defines an upper incisor engaging surface proximate the rearward end of the conduit, and an upper lip engaging surface located between the upper incisor engaging surface and the forward end of the conduit, wherein the lower wall defines a lower incisor engaging surface proximate the rearward end of the conduit, and a lower lip engaging surface located between the lower incisor engaging surface and the forward end of the conduit, and wherein the mouthguard is a multi-layer construction, and wherein the conduit includes a core layer comprising a first polymer and defining the air channel, and an outer layer comprising a second polymer and defining the upper and lower incisor engaging surfaces and at least part of the upper and lower lip engaging surfaces.

2. The mouthguard of claim 1, wherein the lateral bite wings comprise the second polymer and are formed integrally with the outer layer of the conduit.

3. The mouthguard of claim 2, further comprising a flange disposed about and extending radially outward from the forward end of the conduit.

4. The mouthguard of claim 3, wherein the flange comprises a support wall and a preform secured thereto, the support wall extending radially outward with respect to the forward end of the conduit and including a front surface and a rear surface, the preform including a preform wall shaped to generally conform to the front surface of the support wall, a preform opening through the preform wall, and a preform projection extending rearward from the preform wall around a periphery of the preform opening, wherein the preform opening defines the front opening of the air channel.

5. The mouthguard of claim 4, wherein the preform is more rigid than the support wall.

6. The mouthguard of claim 4, wherein the front surface of the support wall includes a recessed region, and wherein the preform wall is disposed within the recessed region.

7. The mouthguard of claim 4, wherein the projection of the preform abuts a forward end of the core layer.

8. The mouthguard of claim 3, wherein the flange comprises the second polymer and is formed integrally with the lateral bite wings and the outer layer of the conduit.

9. A mouthguard comprising:

a pair of spaced lateral bite wings, each having an upper teeth engaging surface, a lower teeth engaging surface, a forward portion and a rearward portion;

a conduit disposed between the forward portions of the lateral bite wings, the conduit having a forward end, a rearward end, and upper and lower walls extending between the forward and rearward ends of the conduit, the conduit defining an air channel extending therethrough from the forward end to the rearward end, the air channel having a front opening at the forward end of the conduit and a rear opening at the rearward end of the conduit;

a front lip shield member disposed about and extending radially outward with respect to the forward end of the conduit, wherein the front lip shield member includes a rear face positioned and shaped to confront an outer surface of a user's lips when in use, wherein the conduit is tapered inward from the forward end to the rearward end thereof such that a distance between the upper and lower walls at the forward end is greater than a distance between the upper and lower walls at the rearward end, wherein the front opening of the air channel has a larger cross-sectional area than the rear opening of the air channel, wherein the upper and lower walls define, respectively an upper incisor engaging surface and a lower incisor engaging surface, the upper and lower incisor engaging surfaces being located proximate the rearward end of the conduit, wherein the mouthguard is a multi-layer construction, the upper teeth engaging surface and the lower teeth engaging surface of one of the lateral bite wings comprises a first polymer and the front lip shield member comprises a second polymer, and further comprising a first border portion disposed along an outer periphery of the one of the lateral bite wings, wherein the first border portion comprises the second polymer and is integrally formed with the front lip shield member.

10. The mouthguard of claim 9, wherein the upper wall of the conduit further defines an upper lip engaging surface, and the lower wall of the conduit further defines a lower lip engaging surface, the upper and lower lip engaging surfaces being located between, respectively, the upper and lower incisor engaging surfaces and the front lip shield member.

11. The mouthguard of claim 9, further comprising an interior wall within the air channel, the interior wall extending from the lower wall of the conduit to the upper wall of the conduit, the interior wall being located between the upper and lower incisor engaging surfaces.

12. The mouthguard of claim 9, wherein the upper teeth engaging surface and the lower teeth engaging surface of the other of the lateral bite wings comprises the first polymer, and further comprising a second border portion disposed along an outer periphery of the other of the lateral bite wings, wherein the second border portion comprises the second polymer and is integrally formed with the front lip shield member.

13. The mouthguard of claim 9, wherein the upper wall of the conduit is disposed at an angle and extends toward the lower wall of the conduit proceeding away from the forward end of the conduit and toward the rearward end of the conduit.

14. A mouthguard comprising:

a pair of spaced lateral bite wings, each having an upper teeth engaging surface, a lower teeth engaging surface, a forward portion and a rearward portion;

a conduit disposed between the forward portions of the lateral bite wings, the conduit having a forward end, a rearward end, and upper and lower walls extending between the forward and rearward ends of the conduit, the conduit defining an air channel extending therethrough from the forward end to the rearward end, the air channel having a front opening at the forward end of the conduit and a rear opening at the rearward end of the conduit;

a front lip shield member disposed about and extending radially outward with respect to the forward end of the conduit, wherein the front lip shield member includes a rear face positioned and shaped to confront an outer surface of a user's lips when in use, wherein the conduit is tapered inward from the forward end to the rearward end thereof such that a distance between the upper and lower walls at the forward end is greater than a distance between the upper and lower walls at the rearward end, wherein the front opening of the air channel has a larger cross-sectional area than the rear opening of the air channel, wherein the upper and lower walls define, respectively an upper incisor engaging surface and a lower incisor engaging surface, the upper and lower incisor engaging surfaces being located proximate the rearward end of the conduit, wherein the front lip shield member comprises a support wall and a preform secured thereto, the support wall extending radially outward with respect to the forward end of the conduit and including a front surface and the rear face of the front lip shield member, the preform including a preform wall shaped to generally conform to the front surface of the support wall, a preform opening through the preform wall, and a preform projection extending rearward from the preform wall around a periphery of the preform opening, wherein the preform opening defines the front opening of the air channel.

15. The mouthguard of claim 14, wherein the preform is more rigid than the support wall.

16. The mouthguard of claim 14, wherein the front surface of the support wall includes a recessed region, and wherein the preform wall is disposed within the recessed region.

17. The mouthguard of claim 14, wherein the projection of the preform abuts a forward end of the core layer.

18. A mouthguard comprising:

a pair of spaced lateral bite wings, each having an upper teeth engaging surface, a lower teeth engaging surface, a forward portion and a rearward portion;

a conduit disposed between the forward portions of the lateral bite wings, the conduit having a forward end, a rearward end, and upper and lower walls extending between the forward and rearward ends of the conduit, the conduit defining an air channel extending therethrough from the forward end to the rearward end, the air channel having a front opening at the forward end of the conduit and a rear opening at the rearward end of the conduit;

wherein the conduit is tapered inward from the forward end to the rearward end thereof such that a distance between the upper and lower walls at the forward end is greater than a distance between the upper and lower walls at the rearward end, wherein the front opening of the air channel has a larger cross-sectional area than the rear opening of the air channel, wherein the upper wall defines an upper incisor engaging surface proximate the rearward end of the conduit, and an upper lip engaging surface located between the upper incisor engaging surface and the forward end of the conduit, wherein the lower wall defines a lower incisor engaging surface proximate the rearward end of the conduit, and a lower lip engaging surface located between the lower incisor engaging surface and the forward end of the conduit, and wherein the mouthguard is a multi-layer construction, the upper teeth engaging surface and the lower teeth engaging surface of one of the lateral bite wings comprises a first polymer, and further comprising a first border portion disposed along an outer periphery of the one of the lateral bite wings, wherein the first border portion comprises a second polymer.

19. The mouthguard of claim 18, further comprising an interior wall within the air channel, the interior wall extending from the lower wall of the conduit to the upper wall of the conduit, the interior wall being located between the upper and lower incisor engaging surfaces.

20. The mouthguard of claim 18, wherein the upper teeth engaging surface and the lower teeth engaging surface of the other of the lateral bite wings comprises the first polymer, and further comprising a second border portion disposed along an outer periphery of the other of the lateral bite wings, wherein the second border portion comprises the second polymer.

21. A mouthguard comprising:

a pair of spaced lateral bite wings, each having an upper teeth engaging surface, a lower teeth engaging surface, a forward portion and a rearward portion;

a conduit disposed between the forward portions of the lateral bite wings, the conduit having a forward end, a rearward end, and upper and lower walls extending between the forward and rearward ends of the conduit, the conduit defining an air channel extending therethrough from the forward end to the rearward end, the air channel having a front opening at the forward end of the conduit and a rear opening at the rearward end of the conduit;

a front lip shield member disposed about and extending radially outward with respect to the forward end of the conduit, wherein the front lip shield member includes a rear face positioned and shaped to confront an outer surface of a user's lips when in use, wherein the conduit is tapered inward from the forward end to the rearward end thereof such that a distance between the upper and lower walls at the forward end is greater than a distance between the upper and lower walls at the rearward end, wherein the front opening of the air channel has a larger cross-sectional area than the rear opening of the air channel, wherein the upper and lower walls define, respectively an upper incisor engaging surface and a lower incisor engaging surface, the upper and lower incisor engaging surfaces being located proximate the rearward end of the conduit, and wherein the mouthguard is a multi-layer construction, and wherein the conduit includes a core layer comprising a first polymer and defining the air channel, and an outer layer comprising a second polymer and defining the upper and lower incisor engaging surfaces and at least part of the upper and lower lip engaging surfaces.

22. The mouthguard of claim 21, wherein the lateral bite wings comprise the second polymer and are formed integrally with the outer layer of the conduit.

23. The mouthguard of claim 21, wherein the front lip shield member comprises the second polymer and is formed integrally with the lateral bite wings and the outer layer of the conduit.

24. A mouthguard comprising:

a pair of spaced lateral bite wings, each having an upper teeth engaging surface, a lower teeth engaging surface, a forward portion and a rearward portion;

a conduit disposed between the forward portions of the lateral bite wings, the conduit having a forward end, a rearward end, and upper and lower walls extending between the forward and rearward ends of the conduit, the conduit defining an air channel extending therethrough from the forward end to the rearward end, the air channel having a front opening at the forward end of the conduit and a rear opening at the rearward end of the conduit;

a front lip shield member disposed about and extending radially outward with respect to the forward end of the conduit, wherein the front lip shield member includes a rear face positioned and shaped to confront an outer surface of a user's lips when in use, a flange disposed about and extending radially outward from the forward end of the conduit, wherein the front lip shield member is removable and is configured to mechanically couple to the flange, wherein the conduit is tapered inward from the forward end to the rearward end thereof such that a distance between the upper and lower walls at the forward end is greater than a distance between the upper and lower walls at the rearward end, wherein the front opening of the air channel has a larger cross-sectional area than the rear opening of the air channel, and wherein the upper and lower walls define, respectively an upper incisor engaging surface and a lower incisor engaging surface, the upper and lower incisor engaging surfaces being located proximate the rearward end of the conduit.

* * * * *